US008591830B2

(12) United States Patent
Sudarsan et al.

(10) Patent No.: US 8,591,830 B2
(45) Date of Patent: Nov. 26, 2013

(54) BEAD MANIPULATIONS ON A DROPLET ACTUATOR

(75) Inventors: Arjun Sudarsan, Cary, NC (US); Michael G. Pollack, Durham, NC (US); Prasanna Thwar, Sunnyvale, CA (US); Dwayne Allen, Durham, NC (US)

(73) Assignee: Advanced Liquid Logic, Inc., Research Triangle Park, NC (US)

( * ) Notice: Subject to any disclaimer, the term of this patent is extended or adjusted under 35 U.S.C. 154(b) by 455 days.

(21) Appl. No.: 12/673,893

(22) PCT Filed: Aug. 25, 2008

(86) PCT No.: PCT/US2008/074151

§ 371 (c)(1),
(2), (4) Date: Nov. 24, 2010

(87) PCT Pub. No.: WO2009/029561

PCT Pub. Date: Mar. 5, 2009

(65) Prior Publication Data

US 2011/0086377 A1 Apr. 14, 2011

Related U.S. Application Data

(60) Provisional application No. 60/957,717, filed on Aug. 24, 2007, provisional application No. 60/980,767, filed on Oct. 17, 2007.

(51) Int. Cl.
*B01L 3/00* (2006.01)

(52) U.S. Cl.
USPC ..... 422/502; 422/503; 422/504; 422/551; 422/552; 422/553; 422/417

(58) Field of Classification Search
USPC ..... 422/502–504, 533, 551–553, 417–429; 204/600–609
See application file for complete search history.

(56) References Cited

U.S. PATENT DOCUMENTS 4,849,340 A * 7/1989 Oberhardt ..... 435/13
6,485,690 B1 11/2002 Pfost et al.

(Continued)

FOREIGN PATENT DOCUMENTS

JP H10267801 A 10/1998
JP 2002233792 A 8/2002

(Continued)

OTHER PUBLICATIONS

Nguyen et al., "Manipulation of ferrofluid droplets using planar coils", Applied Physics Letters, 2006, vol. 89, pp. 052509-1 to 052509-3.*

(Continued)

*Primary Examiner* — Brian R Gordon
(74) *Attorney, Agent, or Firm* — William A. Barrett; Ward and Smith, P.A.

(57) ABSTRACT

A droplet actuator comprising: (a) a base substrate comprising electrodes configured for conducting droplet operations on a droplet operations surface thereof; (b) a droplet comprising one or more beads situated on the droplet operations surface; (c) a barrier arranged in relation to the droplet and the electrodes such that a droplet may be transported away from the beads using one or more droplet operations mediated by one or more of the electrodes while transport of the beads is restrained by a barrier. Related methods and kits are also provided.

1 Claim, 8 Drawing Sheets

(56) References Cited

U.S. PATENT DOCUMENTS

Figure 1A:
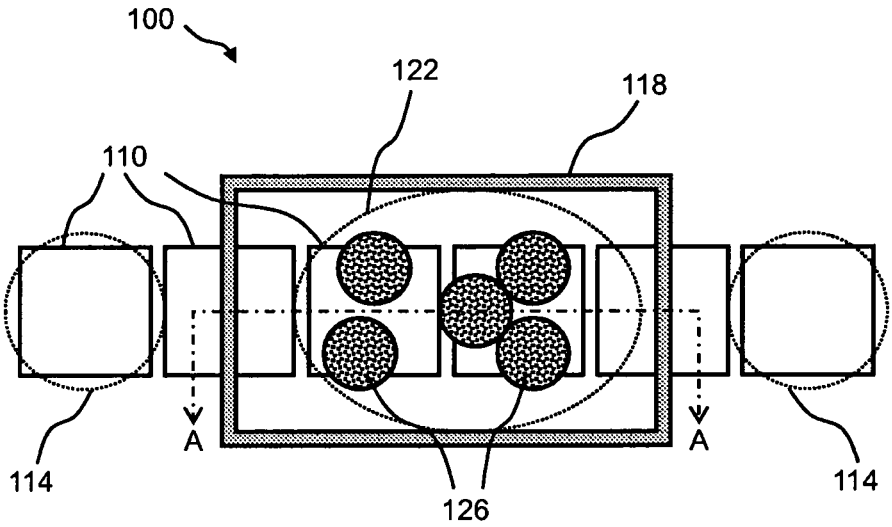

| | | | | |
|---|---|---|---|---|
| 6,565,727 | B1 | 5/2003 | Shenderov | |
| 6,649,343 | B1 * | 11/2003 | Hirota et al. | 435/6.18 |
| 6,705,716 | B2 | 3/2004 | Mott | |
| 6,773,566 | B2 | 8/2004 | Shenderov | |
| 6,870,584 | B2 | 3/2005 | Kawase et al. | |
| 6,870,661 | B2 * | 3/2005 | Pullen et al. | 359/296 |
| 6,911,132 | B2 | 6/2005 | Pamula et al. | |
| 6,977,033 | B2 | 12/2005 | Becker et al. | |
| 7,052,244 | B2 | 5/2006 | Fouillet et al. | |
| 7,163,612 | B2 | 1/2007 | Sterling et al. | |
| 7,255,780 | B2 | 8/2007 | Shenderov | |
| 7,328,979 | B2 | 2/2008 | Decre et al. | |
| 7,365,022 | B2 | 4/2008 | Wong et al. | |
| 7,439,014 | B2 | 10/2008 | Pamula et al. | |
| 7,458,661 | B2 | 12/2008 | Kim et al. | |
| 7,547,380 | B2 | 6/2009 | Velev | |
| 7,641,779 | B2 | 1/2010 | Becker et al. | |
| 7,727,466 | B2 | 6/2010 | Meathrel et al. | |
| 7,901,947 | B2 | 3/2011 | Pollack et al. | |
| 7,943,030 | B2 | 5/2011 | Shenderov | |
| 7,960,184 | B2 * | 6/2011 | Morozov et al. | 436/526 |
| 8,088,578 | B2 * | 1/2012 | Hua et al. | 435/6.1 |
| 8,093,064 | B2 | 1/2012 | Shah et al. | |
| 8,435,463 | B2 * | 5/2013 | Masters et al. | 422/503 |
| 2002/0168297 | A1 | 11/2002 | Shvets et al. | |
| 2006/0194331 | A1 | 8/2006 | Pamula | |
| 2007/0023292 | A1 | 2/2007 | Kim et al. | |
| 2007/0064990 | A1 | 3/2007 | Roth | |
| 2007/0086927 | A1 * | 4/2007 | Natarajan et al. | 422/102 |
| 2007/0207513 | A1 | 9/2007 | Sorensen et al. | |
| 2008/0124252 | A1 | 5/2008 | Marchand et al. | |
| 2008/0151240 | A1 | 6/2008 | Roth | |
| 2008/0274513 | A1 | 11/2008 | Shenderov | |
| 2008/0283414 | A1 | 11/2008 | Monroe et al. | |
| 2008/0305481 | A1 | 12/2008 | Whitman et al. | |
| 2009/0192044 | A1 | 7/2009 | Fouillet | |
| 2009/0321262 | A1 | 12/2009 | Adachi et al. | |
| 2010/0032293 | A1 * | 2/2010 | Pollack et al. | 204/450 |
| 2010/0096266 | A1 | 4/2010 | Kim et al. | |
| 2011/0118132 | A1 | 5/2011 | Winger et al. | |
| 2011/0209998 | A1 | 9/2011 | Shenderov | |
| 2012/0132528 | A1 | 5/2012 | Shenderov | |

FOREIGN PATENT DOCUMENTS

| | | | |
|---|---|---|---|
| JP | 2002340747 | A | 11/2002 |
| JP | 2003118123 | A | 4/2003 |
| JP | 2004085322 | A | 3/2004 |
| JP | 2005140790 | A | 6/2005 |
| JP | 2005249735 | A | 9/2005 |
| JP | 2007093605 | A | 4/2007 |
| JP | 2007193344 | A | 8/2007 |
| KR | 20030003078 | A | 1/2003 |
| WO | 02066992 | A1 | 8/2002 |
| WO | 2004083828 | A1 | 9/2004 |
| WO | 2005069015 | A1 | 7/2005 |
| WO | 2006124458 | A2 | 11/2006 |
| WO | 2007120241 | | 10/2007 |
| WO | 2008098236 | | 8/2008 |
| WO | 2008101194 | | 8/2008 |
| WO | 2008134153 | | 11/2008 |
| WO | 2009003184 | | 12/2008 |
| WO | 2009021173 | | 2/2009 |
| WO | 2010027894 | | 3/2010 |

OTHER PUBLICATIONS

Boles et al., "Droplet-Based Pyrosequencing Using Digital Microfluidics," Analytical Chemistry, vol. 83, pp. 8439-8447, Sep. 2011.

Dewey et al., "Towards a Visual Modeling Approach to Designing Microelectromechanical System Transducers," Journal of Micromechanics and Microengineering, vol. 9, pp. 332-340, Dec. 1999.

Dewey et al., "Visual Modeling and Design of Microelectromechanical System Transducers," Microelectronics Journal, vol. 32, pp. 373-381, Apr. 2001.

Fair et al., "A Microwatt Metal Insulator Solution Transport (MIST) Device for Scalable Digital Biomicrofluidic Systems," IEEE IEDM Technical Digest, pp. 16.4.1-16.4.4, 2001.

Fair et al., "Electrowetting-Based On-Chip Sample Processing for Integrated Microfluidics," IEEE Int'l Electron Devices Meeting (IEDM), 2003.

Fair et al., "Integrated Chemical/Biochemical Sample Collection, Pre-Concentration, and Analysis on a Digital Microfluidic Lab-on-a-Chip Platform," Lab-on-a-Chip: Platforms, Devices, and Applications, Conf. 5591, SPIE Optics East, Philadelphia, Oct. 25-28, 2004.

Fair et al., "Bead-Based and Solution-Based Assays Performed on a Digital Microfluidic Platform," Biomedical Engineering Society (BMES) Fall Meeting, Baltimore, MD, Oct. 1, 2005.

Fair et al., "Chemical and Biological Applications of Digital Microfluidic Devices," IEEE Design and Test of Computers, vol. 24(1): pp. 10-24, Jan.-Feb. 2007.

Hua et al., "Multiplexed Real-Time Polymerase Chain Reaction on a Digital Microfluidic Platform," Analytical Chemistry, vol. 82, pp. 2310-2316, Mar. 2010.

Kleinert et al., "Dynamics and Stability of Oil Films During Droplet Transport by Electrowetting," 86th ACS Colloid & Surface Science Symposium, Jun. 13, 2012.

Millington et al., "Digital Microfluidics: A Future Technology in the Newborn Screening Laboratory?," Seminars in Perinatology, vol. 34, pp. 163-169, Apr. 2010.

Paik et al., "Rapid Droplet Mixers for Digital Microfluidic Systems," Lab on a Chip, vol. 3, pp. 253-259, 2003. (More mixing videos available, along with the article, at LOC's website.).

Paik et al., "Electrowetting-Based Droplet Mixers for Microfluidic Systems," Lab on a Chip (LOC), vol. 3, pp. 28-33, 2003 (more mixing videos available, along with the article, at LOC's website).

Paik et al., "Thermal Effects on Droplet Transport in Digital Microfluidics with Applications to Chip Cooling Processing for Integrated Microfluidics," Int'l Conf. on Thermal, Mechanics, and Thermomechanical Phenomena in Electronic Systems (ITherm), pp. 649-654, 2004.

Paik et al., "Coplanar Digital Microfluidics Using Standard Printed Circuit Board Processes," 9th Int'l Conf. on Miniaturized Systems for Chemistry and Life Sciences, Boston, MA, pp. 566-568, Oct. 9-13, 2005.

Paik et al., "Droplet-Based Hot Spot Cooling Using Topless Digital Microfluidics on a Printed Circuit Board," Int'l Workshops on Thermal Investigations of ICs and Systems (THERMINIC), pp. 278-283, 2005.

Paik et al., "Adaptive Hot-Spot Cooling of Integrated Circuits Using Digital Microfluidics," ASME Int'l Mechanical Engineering Congress and Exposition (IMECE), Nov. 5-11, 2005.

Paik et al., "Programmable Flow-Through Real-Time PCR Using Digital Microfluidics," 11th Int'l Conf. on Miniaturized Systems for Chemistry and Life Sciences, Paris, France, pp. 1559-1561, Oct. 7-11, 2007.

Paik et al., "Adaptive Cooling of Integrated Circuits Using Digital Microfluidics," accepted for publication in IEEE Transactions on VLSI Systems, 2007, and Artech House, Norwood, MA, 2007.

Paik et al., "A Digital-Microfluidic Approach to Chip Cooling," IEEE Design & Test of Computers, vol. 25, pp. 372-381, Jul. 2008.

Pamula et al., "Microfluidic Electrowetting-Based Droplet Mixing," Proceedings, MEMS Conf. Berkeley, pp. 8-10, Aug. 2001.

Pamula et al., "Cooling of Integrated Circuits Using Droplet-Based Microfluidics," Proc. ACM Great Lakes Symposium on VLSI, pp. 84-87, 2003.

Pamula et al., "A Droplet-Based Lab-on-a-Chip for Colorimetric Detection of Nitroaromatic Explosives," Proceedings of Micro Electro Mechanical Systems, pp. 722-725, 2005.

Pollack et al., "Electrowetting-Based Actuation of Liquid Droplets for Microfluidic Applications," Applied Physics Letters, vol. 77, No. 11, pp. 1725-1726, Sep. 11, 2000.

Pollack, M.G., "Electrowetting-Based Microactuation of Droplets for Digital Microfluidics," Ph.D. Thesis, Department of Electrical and Computer Engineering, Duke University, 2001.

(56) References Cited

OTHER PUBLICATIONS

Pollack et al., "Electrowetting-Based Microfluidics for High-Throughput Screening," SmallTalk 2001 Conf. Program Abstract, p. 149, San Diego, Aug. 2001.
Pollack et al., "Electrowetting-Based Actuation of Droplets for Integrated Microfluidics," Lab on a Chip (LOC), vol. 2, pp. 96-101, 2002.
Pollack et al., "Investigation of Electrowetting-Based Microfluidics for Real-Time PCR Applications," 7th Int'l Conf. on Micro Total Analysis Systems (μTAS), 2003.
Pollack et al., "Applications of Electrowetting-Based Digital Microfluidics in Clinical Diagnostics," Expert Rev. Mol. Diagn., vol. 11(4), pp. 393-407, 2011.
Punnamaraju et al., "Voltage Control of Droplet Interface Bilayer Lipid Membrane Dimensions," Langmuir The Acs Journal of Surfaces and Colloids, vol. 27, Issue 2, pp. 618-626, 2011.
Punnamaraju, S., "Voltage and Photo Induced Effects in Droplet-Interface-Bilayer Lipid Membranes," PhD Thesis, University of Cincinnati, 2011.
Ren et al., "Dynamics of Electro-Wetting Droplet Transport," Sensors and Actuators B (Chemical), vol. B87, No. 1, 201-6, 2002.
Ren et al., "Micro/Nano Liter Droplet Formation and Dispensing by Capacitance Metering and Electrowetting Actuation," IEEE-NANO, pp. 369-372, 2002.
Ren et al., "Automated Electrowetting-Based Droplet Dispensing with Good Reproducibility," Proc. Micro Total Analysis Systems (μTAS), pp. 993-996, 2003.
Ren H., R.B. Fair, M.G. Pollack "Automated On-Chip Droplet Dispensing with Volume Control by Electro-Wetting Actuation and Capacitance Metering," Sensors and Actuators B, 98, pp. 319-327, 2004.
Schell et al., "Evaluation of a Digital Microfluidic real-time PCR Platform to detect DNA of *Candida albicans* in Blood," J. Clin Microbiol Infect Dis, Published on-line DOI 10.1007/s10096-012-15616, Feb. 2012.
Sista, R., "Development of a Digital Microfluidic Lab-on-a-Chip for Automated Immunoassay with Magnetically Responsive Beads," Ph.D. Thesis, Dep't of Chemical Engineering, Florida State University, 2007.
Sista et al., "Development of a Digital Microfluidic Platform for Point of Care Testing," Lab on a Chip, vol. 8, pp. 2091-2104, Dec. 2008.
Sista et al., "Heterogeneous Immunoassays Using Magnetic Beads on a Digital Microfluidic Platform," Lab on a Chip, vol. 8, pp. 2188-2196, Dec. 2008.
Sista et al., "Digital Microfluidic Platform for Multiplexing Enzyme Assays: Implications for Lysosomal Storage Disease Screening in Newborns," Clinical Chemistry, vol. 57, pp. 1444-1451, 2011.
Sista et al., "Rapid, Single-Step Assay for Hunter Syndrome in Dried Blood Spots Using Digital Microfluidics," Clinica Chimica Acta, vol. 412, pp. 1895-1897, 2011.
Srinivasan et al., "Scalable Macromodels for Microelectromechanical Systems," Technical Proc. 2001 Int'l Conf. on Modeling and Simulation of Microsystems, pp. 72-75, 2001.
Srinivasan et al., "A Digital Microfluidic Biosensor for Multianalyte Detection," Proc. IEEE 16th Annual Int'l Conf. on Micro Electro Mechanical Systems, pp. 327-330, 2003.
Srinivasan et al., "Clinical Diagnostics on Human Whole Blood, Plasma, Serum, Urine, Saliva, Sweat, and Tears on a Digital Microfluidic Platform," Proc. Micro Total Analysis Systems (UTAS), pp. 1287-1290, 2003.
Srinivasan et al., "3-D Imaging of Moving Droplets for Microfluidics Using Optical Coherence Tomography," Micro Total Analysis Systems (μTAS), pp. 1303-1306, 2003.
Srinivasan et al., "Droplet-Based Microfluidic Lab-on-a-Chip for Glucose Detection," Analytica Chimica Acta , vol. 507, No. 1, pp. 145-150, 2004.
Srinivasan et al., "An Integrated Digital Microfluidic Lab-on-a-Chip for Clinical Diagnostics on Human Physiological Fluids," Lab on a Chip, vol. 4, pp. 310-315, 2004.
Srinivasan et al., "Protein Stamping for MALDI Mass Spectrometry Using an Electrowetting-Based Microfluidic Platform," Lab-on-a-Chip: Platforms, Devices, and Applications, Conf. 5591, SPIE Optics East, Philadelphia, Oct. 25-28, 2004.
Srinivasan, V., "A Digital Microfluidic Lab-on-a-Chip for Clinical Diagnostic Applications," Ph.D. thesis, Dep't of Electrical and Computer Engineering, Duke University, 2005.
Su et al., "Yield Enhancement of Digital Microfluidics-Based Biochips Using Space Redundancy and Local Reconfiguration," Proc. Design, Automation and Test in Europe (DATE) Conf., pp. 1196-1201, 2005.
Tolun et al., "A Novel Fluorometric Enzyme Analysis Method for Hunter Syndrome Using Dried Blood Spots," Mol. Genet. Metab. (2012), doi:10.1016/j.ymgme.2001.12.011.
Wulff-Burchfield et al., "Microfluidic Platform Versus Conventional Real-Time Polymerase Chain Reaction for the Detection of Mycolpasma pneumoniae in Respiratory Specimens," Dignostic Microbology and Infectious Disease, 2010, vol. 67, pp. 22-29.
Xu et al., "Digital Microfluidic Biochip Design for Protein Crystallization," IEEE-NIH, 2007.

* cited by examiner

BEAD MANIPULATIONS ON A DROPLET ACTUATOR

2 RELATED PATENT APPLICATIONS

This application claims priority to and incorporates by reference International Application PCT/US2008/074151, filed Aug. 25, 2008, entitled "Bead Manipulations on a Droplet Actuator," which claims priority to and incorporates by reference U.S. Patent Application No. 60/957,717, filed on Aug. 24, 2007, entitled "Bead Washing Using Physical Barriers"; and U.S. Patent Application No. 60/980,767, filed on Oct. 17, 2007, entitled "Bead manipulations in a droplet actuator."

1 GOVERNMENT INTEREST

This invention was made with government support under CA114993-01 and HG003706-01 awarded by the National Institutes of Health of the United States. The United States Government has certain rights in the invention.

3 FIELD OF THE INVENTION

The invention relates generally to the field of droplet actuators and droplet operations conducted using droplet actuators.

4 BACKGROUND

Droplet actuators are used to conduct a wide variety of droplet operations. A droplet actuator typically includes two plates separated by a gap. The plates include electrodes for conducting droplet operations. The space is typically filled with a filler fluid that is immiscible with the fluid that is to be manipulated on the droplet actuator. The formation and movement of droplets is controlled by electrodes for conducting a variety of droplet operations, such as droplet transport and droplet dispensing. When a protocol requires the use of beads, such as magnetic beads, it may be useful to retain the beads in a particular location within the droplet actuator, rather than allowing the beads to move freely throughout the droplet actuator and, therefore, there is a need for alternative approaches to manipulating beads in a droplet actuator.

5 SUMMARY OF THE INVENTION

The invention provides a droplet actuator. In an exemplary embodiment, the droplet actuator may include: a base substrate comprising electrodes configured for conducting droplet operations on a droplet operations surface thereof; a droplet comprising one or more beads situated on the droplet operations surface; a barrier arranged in relation to the droplet and the electrodes such that a droplet may be transported away from the beads using one or more droplet operations mediated by one or more of the electrodes while transport of the beads is restrained by a barrier.

In some cases, the droplet actuator also includes a top substrate, such as a top plate, separated from the droplet operations surface to form a gap for conducting droplet operations. When a top substrate is present, the barrier is coupled to and extends downward from the top substrate. The barrier may be configured to leave a gap between a bottom edge of the barrier and the droplet operations surface.

In some embodiments, the barrier may include a vertical gap through which fluid may pass during a droplet operation mediated by one or more of the electrodes. When present, the vertical gap may, in certain embodiments, be situated over an electrode. In some embodiments, the vertical gap extends substantially from a surface of the top substrate facing the gap and the droplet operations surface.

In some embodiments, the droplet actuator of the invention includes one or more beads are completely surrounded by and/or trapped the barrier. In such an embodiment, the one or more beads are blocked by the barrier from being transported away from the barrier enclosure in any direction, while permitting droplets to be transported into and out of the barrier's enclosure. For example, the barrier may be an enclosed barrier of any shape situated on a path of electrodes configured for transporting droplets into contact with and away from beads which are trapped within the confines of the barrier. The droplets may, for example, contain reagents, samples, and or smaller beads which are sufficiently small to be transported into and out of the barrier. In one embodiment, the barrier comprises a rectangular barrier situated on a path of electrodes configured for transporting droplets, wherein one side of the rectangular barrier is situated about halfway across a first electrode and another side of the rectangular barrier situated about halfway across a second electrode.

In other embodiments, the barrier may include an angular barrier traversing an electrode path and pointing in a direction which is away from a bead retaining area of the barrier. In a similar embodiment, the barrier may include an angular barrier traversing an electrode path and pointing in a direction which is towards a bead retaining region of the barrier.

In one embodiment, the barrier is configured such that one or more beads are blocked by the barrier from being transported away from the barrier in the first direction but not blocked by the barrier from being transported away from the barrier in the second direction. In another embodiment, the barrier includes an opening which permits beads having a size which is below a predetermined size limit to traverse the barrier while retaining beads which are above the predetermined size limit.

The barrier may include an opening which permits beads having a size which is below a predetermined size limit to traverse the barrier while retaining beads which are above the predetermined size limit. In certain embodiments, the droplet actuator comprises two or more barriers, wherein each barrier has a gap which is sized to retain beads of a different predetermined bead size limit.

In certain embodiments, the barrier is traversed by a first elongated, gradually narrowing droplet operations electrode, having a thick base at a first end thereof on a bead retaining side of the barrier and gradually narrowing to a narrow apex at a second end on an opposite side of the barrier. In another embodiment the barrier is traversed by a first elongated, gradually narrowing droplet operations electrode, having a thick base at a first end thereof opposite a bead retaining side of the barrier and gradually narrowing to a narrow apex at a second end on a bead retaining side of the barrier. For example, the first droplet operations electrode may have a generally triangular shape having two sides that are similar in length and substantially longer than a third side. The triangular shape may comprise elongated right triangle, equilateral triangle, or scalene triangle. In certain embodiments, a second elongated, gradually narrowing droplet operations electrode oriented alongside the first gradually narrowing droplet operations electrode such that: the base of the first gradually narrowing droplet operations electrode is adjacent to the apex of the second gradually narrowing droplet operations electrode; and the apex of the first gradually narrowing droplet operations electrode is adjacent to the base of the second gradually narrowing droplet operations electrode. In certain embodiments, the droplet actuator includes two sets of the first and second elongated gradually narrowing droplet operations electrodes traversing the barrier.

The beads used in the droplet actuator of the invention may, in some embodiments, comprise biological cells bound thereto. The beads may, for example, include substantially pure populations biological cells bound thereto. In other embodiments, the barriers may be used to retain free biological cells or clumps of biological cells during a droplet operation.

In another embodiment, the droplet actuator includes: a base substrate comprising electrodes configured for conducting droplet operations on a droplet operations surface thereof; a funnel-shaped reservoir having a narrow opening situated in proximity to the base substrate; wherein the foregoing are arranged such that a portion of a sample comprising beads loaded in the funnel will flow onto the droplet operations surface, and wherein the portion of the sample comprises a substantial amount of the beads. In another embodiment, a magnetic field source may be situated in a manner which attracts magnetic beads from the funnel-shaped reservoir onto the substrate surface. A top substrate may be arranged in a manner which is parallel to the droplet operations surface, and the narrow opening of the funnel shaped reservoir may pass through the top substrate.

In yet another embodiment, the droplet actuator includes: a base substrate comprising electrodes configured for conducting droplet operations on a droplet operations surface thereof; a top substrate arranged in a generally parallel fashion relative to the droplet operations surface; and beads trapped in a barrier on the droplet actuator, wherein the barrier permits droplets to be transported in to and out of the barrier using droplet operations mediated by one or more of the electrodes, while retaining one or more of the beads within the barrier. In some cases, the barrier retains substantially all of the beads within the barrier. In certain embodiments, two or more of the electrodes are arranged for conducting droplet operations within the barrier. The droplet actuator may include an array of barriers, each barrier retaining beads comprising a specific bead type, the array including a multiplicity of bead types. The beads comprise biological cells bound thereto. The beads may include a substantially pure population of biological cells bound thereto.

The invention also includes a method of reducing a volume of fluid surrounding a bead. The method may include transporting a portion of the volume of fluid past a barrier on a droplet actuator, where in the barrier restrains transport of the bead while permitting the fluid to pass. The beads may include biological cells bound thereto. The volume of fluid may include culture medium selected for growing the biological cells. The transporting may be conducted using one or more droplet operations. The droplet operations may be electrode mediated. The droplet operations may be electrowetting mediated. The droplet operations may be dielectrophoresis mediated. The portion of the volume of fluid may be further subjected to one or more droplet operations in an assay protocol.

The invention provides a method of providing a nutrient to a biological cell. The method may, in some embodiments, generally include: reducing a volume of fluid surrounding a bead comprising biological cells adhered thereto; and conducting one or more droplet operations to bring into contact with the beads a fluid comprising the nutrient. The beads may include a substantially pure population of biological cells bound thereto. The beads may include interacting populations of cells.

The invention also includes a method of separating a volume of fluid from one or more beads, the method comprising transporting the volume of fluid past a barrier on a droplet actuator, wherein the barrier restrains transport of one or more of the one or more beads.

Further, the invention includes a method of transporting a droplet substantially free of beads away from a droplet containing beads. The method may, for example, include: providing a droplet actuator as described herein; and transporting the droplet containing beads across the barrier, wherein the barrier retains the beads and a droplet substantially free of beads is formed on an opposite side of the barrier.

The invention also includes a method of washing beads on a droplet actuator. The method may include: (a) providing a droplet actuator as described herein; (b) transporting the droplet containing beads across the barrier, wherein the barrier retains the beads and a droplet substantially free of beads is formed on an opposite side of the barrier; (c) transporting a wash droplet into contact with the beads; and (d) repeating the foregoing steps (b) and (c) until washing of the beads is complete.

The invention also includes a method of sorting beads on a droplet actuator. The method may include: providing a droplet actuator comprising: a base substrate comprising electrodes configured for conducting droplet operations on a droplet operations surface thereof; a first barrier arranged to permit beads having a size which is below a first predetermined size to traverse the barrier while retaining beads which are above the first predetermined size; transporting a droplet comprising beads having at least three sizes through the first barrier to provide a retained droplet comprising beads above the first predetermined size and a transmitted droplet comprising beads above the first predetermined size. In a related embodiment, the droplet actuator further comprises a second barrier arranged to permit beads having a size which is below a second predetermined size to traverse the barrier while retaining beads which are above the second predetermined size; the method further comprises transporting a droplet comprising beads having at least three sizes through the first barrier to provide a retained droplet comprising beads above the first predetermined size and a transmitted droplet comprising beads above the first predetermined size; transporting the retained droplet through the second barrier to provide a retained droplet comprising beads above the first and second predetermined sizes and a transmitted droplet comprising beads above the first predetermined size and below the second predetermined size.

The invention further includes a method of making a droplet actuator. The method comprising situating beads in a barrier on a droplet actuator between a top substrate and a droplet operations surface, wherein the barrier blocks transport of the beads outside of the barrier on all sides and permits fluid to be transported via droplet operations into and/or out of the barrier.

The invention further includes a kit. The kit generally includes a droplet actuator. The droplet actuator includes beads situated within a barrier between the top substrate and a droplet operations surface thereof and a further component selected from the group consisting of a filler fluid for use with the droplet actuator; a reagent for use of the droplet actuator, a device for use in loading of fluid on the droplet actuator.

6 DEFINITIONS

As used herein, the following terms have the meanings indicated.

"Activate" with reference to one or more electrodes means effecting a change in the electrical state of the one or more electrodes which results in a droplet operation.

"Bead," with respect to beads on a droplet actuator, means any bead or particle that is capable of interacting with a droplet on or in proximity with a droplet actuator. Beads may be any of a wide variety of shapes, such as spherical, generally spherical, egg shaped, disc shaped, cubical and other three dimensional shapes. The bead may, for example, be capable of being transported in a droplet on a droplet actuator; configured with respect to a droplet actuator in a manner which permits a droplet on the droplet actuator to be brought into contact with the bead, on the droplet actuator and/or off the droplet actuator. Beads may be manufactured using a wide variety of materials, including for example, resins, and polymers. The beads may be any suitable size, including for example, microbeads, microparticles, nanobeads and nanoparticles. In some cases, beads are magnetically responsive; in other cases beads are not significantly magnetically responsive. For magnetically responsive beads, the magnetically responsive material may constitute substantially all of a bead or one component only of a bead. The remainder of the bead may include, among other things, polymeric material, coatings, and moieties which permit attachment of an assay reagent. Examples of suitable magnetically responsive beads are described in U.S. Patent Publication No. 2005-0260686, entitled, "Multiplex flow assays preferably with magnetic particles as solid phase," published on Nov. 24, 2005, the entire disclosure of which is incorporated herein by reference for its teaching concerning magnetically responsive materials and beads. The beads may include one or more populations of biological cells adhered thereto. In some cases, the biological cells are a substantially pure population. In other cases, the biological cells include different cell populations, e.g, cell populations which interact with one another, such as engineered tissue or a whole animal (such as *C. elegans* for example)

"Droplet" means a volume of liquid on a droplet actuator that is at least partially bounded by filler fluid. For example, a droplet may be completely surrounded by filler fluid or may be bounded by filler fluid and one or more surfaces of the droplet actuator. Droplets may take a wide variety of shapes; nonlimiting examples include generally disc shaped, slug shaped, truncated sphere, ellipsoid, spherical, partially compressed sphere, hemispherical, ovoid, cylindrical, and various shapes formed during droplet operations, such as merging or splitting or formed as a result of contact of such shapes with one or more surfaces of a droplet actuator.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining" and the like are used to describe the creation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" and "dividing" are not intended to imply any particular outcome with respect to size of the resulting droplets (i.e., the size of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, capillary loading, and pipette/syringe/dropper loading. Droplet operations may be electrode-mediated. In some cases, droplet operations are further facilitated by the use of hydrophilic and/or hydrophobic regions on surfaces and/or by physical obstacles.

"Washing" with respect to washing a magnetically responsive bead means reducing the amount of one or more substances in contact with the magnetically responsive bead or exposed to the magnetically responsive bead from a droplet in contact with the magnetically responsive bead. The reduction in the amount of the substance may be partial, substantially complete, or even complete. The substance may be any of a wide variety of substances; examples include target substances for further analysis, and unwanted substances, such as components of a sample, contaminants, and/or excess reagent. In some embodiments, a washing operation begins with a starting droplet in contact with a magnetically responsive bead, where the droplet includes an initial total amount of a substance. The washing operation may proceed using a variety of droplet operations. The washing operation may yield a droplet including the magnetically responsive bead, where the droplet has a total amount of the substance which is less than the initial amount of the substance. Other embodiments are described elsewhere herein, and still others will be immediately apparent in view of the present disclosure.

The terms "top" and "bottom," when used, e.g., to refer to the top and bottom substrates of the droplet actuator, are used for convenience only; the droplet actuator is functional regardless of its position in space.

When a given component, such as a layer, region or substrate, is referred to herein as being disposed or formed "on" another component, that given component can be directly on the other component or, alternatively, intervening components (for example, one or more coatings, layers, interlayers, electrodes or contacts) can also be present. It will be further understood that the terms "disposed on" and "formed on" are used interchangeably to describe how a given component is positioned or situated in relation to another component. Hence, the terms "disposed on" and "formed on" are not intended to introduce any limitations relating to particular methods of material transport, deposition, or fabrication.

When a liquid in any form (e.g., a droplet or a continuous body, whether moving or stationary) is described as being "on", "at", or "over" an electrode, array, matrix or surface, such liquid could be either in direct contact with the electrode/array/matrix/surface, or could be in contact with one or more layers or films that are interposed between the liquid and the electrode/array/matrix/surface.

When a droplet is described as being "on" or "loaded on" a droplet actuator, it should be understood that the droplet is arranged on the droplet actuator in a manner which facilitates using the droplet actuator to conduct droplet operations on the droplet, the droplet is arranged on the droplet actuator in a manner which facilitates sensing of a property of or a signal from the droplet, and/or the droplet has been subjected to a droplet operation on the droplet actuator, e.g., a layer of filler fluid.

7 DETAILED DESCRIPTION

The invention provides mechanisms for manipulating beads in a droplet actuator. In certain embodiments, the invention provides physical barriers of varying geometries and features for retaining a quantity of beads in certain locations within a droplet actuator. The physical barriers may be arranged in the gap of a droplet actuator such that one or more electrodes is confined therein. The physical barriers may be configured so that they do not prevent the flow of liquid across the barrier. Therefore, liquid can be made to flow through the physical barrier while the beads are retained in place permitting the liquid surrounding the beads to be removed or replaced with fresh liquid. A quantity of beads may be retained within the physical barrier. The beads may be manipulated using various droplet operations. In another embodiment, the present invention provides a method of manipulating different sized beads using a combination of different physical barriers in a single droplet actuator.

7.1 Bead Manipulations Using Physical Barriers

Figure 1B:
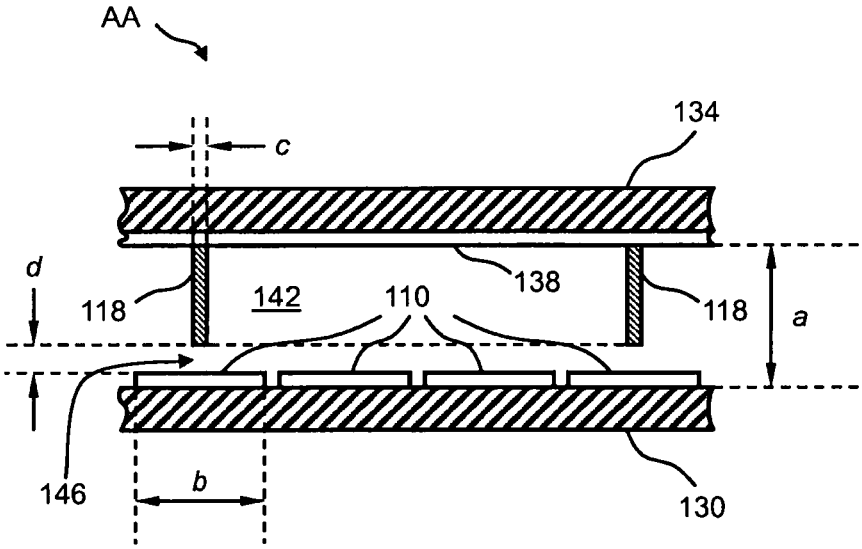

The following examples are illustrative of the scope of the invention:

FIG. 1A illustrates a top view (not to scale) of a droplet actuator 100 that includes a physical barrier that is suitable for manipulating beads. Droplet actuator 100 includes an arrangement of electrodes 110, e.g., electrowetting electrodes, for performing droplet operations on droplets 114. Droplet actuator 100 further includes a physical barrier 118. Physical barrier 118 may be formed in any of a variety of shapes, such as box-shaped (i.e., square or rectangular shape of any designer-specified dimension) and can have different fixed heights or variable height within the same structure. In some cases, the barriers may also not be continuous but be composed of many pillar-like structures. Additionally, FIG. 1A shows that one or more electrodes 110 are confined within physical barrier 118. One or more droplets 122 that contain a quantity of beads 126 may also be retained therein. Droplet actuator 100 may be provided with beads 126 in the physical barrier without droplets. Then during operations, a droplet may be transported via droplet operations into physical barrier 118 in order to surround beads 126. Beads 126 may, in some cases, be magnetically responsive. Examples of suitable magnetically responsive beads are described in U.S. Patent Publication No. 2005-0260686, entitled, "Multiplex flow assays preferably with magnetic particles as solid phase," published on Nov. 24, 3145. FIG. 1B describes more details of droplet actuator 100 that includes physical barrier 118 for manipulating beads 126.

FIG. 1B illustrates a cross-sectional view (not to scale) of a droplet actuator 100, taken along line A-A of FIG. 1A, which shows more details of droplet actuator 100. More specifically, FIG. 1B shows that droplet actuator 100 includes a bottom plate that is formed of a substrate 130 that is associated with electrodes 110. Additionally, droplet actuator 100 includes a top substrate that is formed of a substrate 134 that is associated with ground electrode 138. The bottom and top substrates are arranged having a gap 142 therebetween, which is the fluid channel of droplet actuator 100.

In the example that is illustrated in FIG. 1B, gap 142 has a height a of about 200 microns, each electrode 110 has a width b of about 900 microns, physical barrier 118 has a width c of about 100 microns to about 200 microns, and a space 146 between physical barrier 118 and the surface of a certain electrode 110 has a height d that is less than the diameter of beads 126, in order to prevent beads 126 from passing therethrough, while still allowing fluid to flow therethrough. In one example, space 146 has a height d of about 20 microns to about 40 microns. These dimensions and other dimensions provided in this patent application are for example only, and are not intended to limit the scope of the invention, as the dimensions may be readily adjusted by one of skill in the art.

A physical barrier, such as physical barrier 118 as well as the physical barriers described in the embodiments of FIGS. 2A, 2B, 3, 4, 5, 6, and 7, may be formed of materials, such as, but not limited to, cryotape or solder mask. Furthermore, a physical barrier, such as physical barrier 118 as well as the physical barriers described in the embodiments of FIGS. 2A, 2B, 3, 4, 5, 6, and 7, may be a photo-configurable barrier that may be formed using known photolithography processes as long as the materials do not unduly interfere with the droplet actuator operations.

In operation and referring to FIGS. 1A and 1B, when performing droplet operations, fluid may flow bidirectionally along the fluid channel of droplet actuator 100 and through physical barrier 118 via space 146. During the droplet operations, the quantity of beads 126 are substantially retained, preferably entirely retained, within physical barrier 118 and not allowed to move freely throughout droplet actuator 100. Because there may be two or more electrodes 110 confined within the boundaries of physical barrier 118, droplet operations and bead manipulation may occur within the confines of physical barrier 118. In one example, droplet agitation may occur within the confines of physical barrier 118, such that the movement of beads 126 within droplets 122 facilitates internal mixing of droplet components. The droplet agitation may, for example, facilitate complete mixing of the reagents and/or samples for a reaction and/or complete mixing of a wash solution with the beads.

Figure 2A:
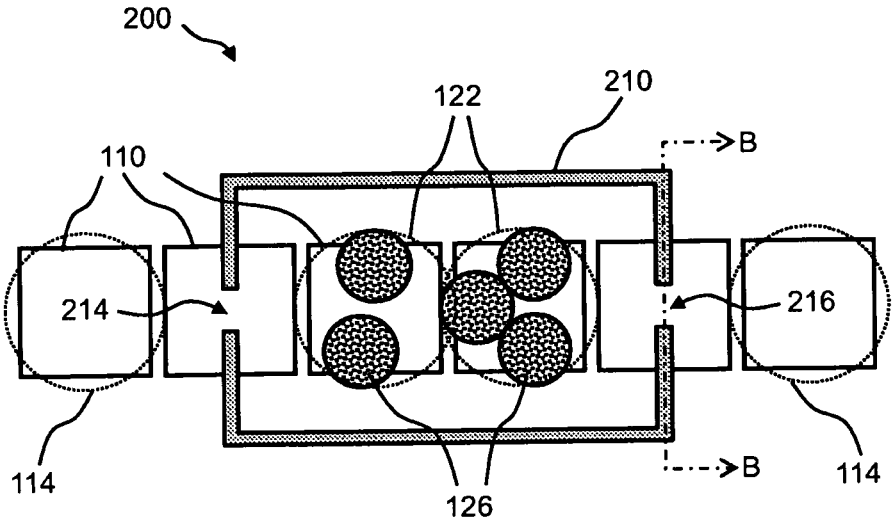
Figure 2B:
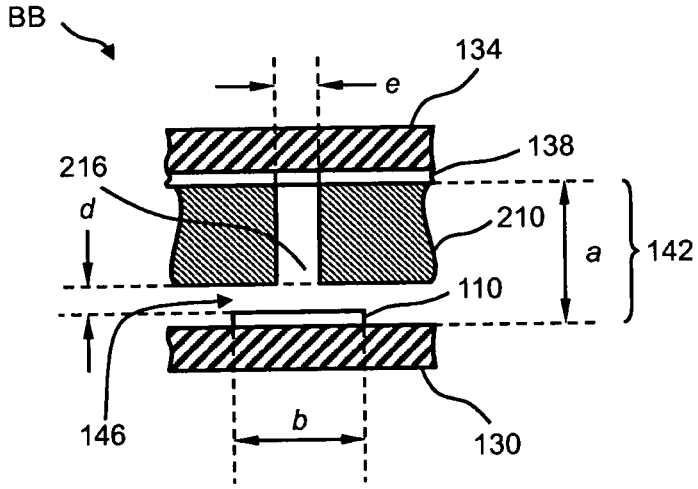

FIG. 2A illustrates a top view (not to scale) of a droplet actuator 200 that includes a physical barrier that is suitable for manipulating beads. Droplet actuator 200 is substantially the same as droplet actuator 100 of FIGS. 1A and 1B, except that physical barrier 118 of FIGS. 1A and 1B is replaced with a physical barrier 210 that has a first gap 214 at one fluid entry/exit end and a second gap 216 at an opposite fluid entry/exit end of physical barrier 210. In an alternative embodiment, multiple gaps 214 and 216 may be provided. The gaps 214 and 215 may be substantially vertical and may extend completely or partially from the top substrate to the bottom substrate. FIG. 2B illustrates more details of droplet actuator 200 that includes physical barrier 210 for manipulating beads 126.

FIG. 2B illustrates a cross-sectional view (not to scale) of a droplet actuator 200, taken along line B-B of FIG. 2A, which shows more details of droplet actuator 200 that has physical barrier 210. In one specific embodiment, gap 142 has a height a of about 200 microns, each electrode 110 has a width b of about 900 microns, as described in FIG. 1B. Additionally, FIG. 2B shows that, for example, space 146 has a width e that is less than the diameter of beads 126, in order to prevent beads 126 from passing therethrough, while still allowing fluid to flow therethrough. In one example, space 146 has a width e of about 20 microns to about 40 microns. Furthermore, in this embodiment the presence of space 146 may be optional. Consequently, the height d of space 146 may range from 0 microns to a height that is less than the diameter of beads 126. This is allowed because the presence of space 216 alone (without space 146) may facilitate the flow of fluid through physical barrier 210. Therefore, in one example, space 146 may have a height d of about 0 microns to about 40 microns.

In operation and referring to FIGS. 2A and 2B, when performing droplet operations, fluid may flow bidirectionally along the fluid channel of droplet actuator 200 and through physical barrier 210 via space 214, space 216, and optionally space 146. During the droplet operations, the quantity of beads 126 are retained entirely within physical barrier 210 and not allowed to move freely throughout droplet actuator 200. Because there may be two or more electrodes 110 confined within the boundaries of physical barrier 210, droplet operations and bead manipulation may occur within the confines of physical barrier 210.

In one embodiment, the present invention can be used as a cell culturing device where the cells are held in place by the physical barriers while the cell culture media are transported into and out of contact with the cells. Transport of the liquid underneath the barrier can be assisted by placing an electrode on the bottom of 210 facing the liquid and electrode 110. These two electrodes can then be used to generate greater wetting force to facilitate droplet transport through a smaller gap d. Cells can be transported into the barrier through the gap e.

Figure 3:
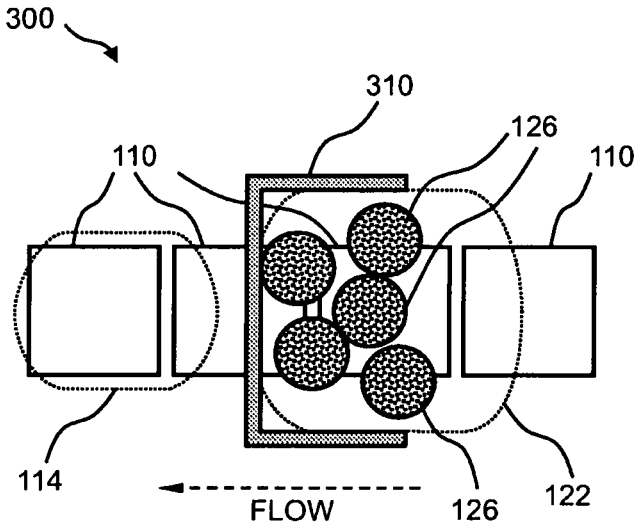

FIG. 3 illustrates a top view (not to scale) of a droplet actuator 300 that includes a physical barrier that is suitable for manipulating beads. Droplet actuator 300 includes the arrangement of electrodes 110 for performing droplet operations on, for example, droplets 114, as described in FIGS. 1A and 1B. Droplet actuator 300 further includes a physical barrier 310, which is, for example, U-shaped and of any useful dimension. The U-shaped physical barrier 310 is useful for preventing movement of droplets in one direction, for example, in the direction indicated in FIG. 3 for the depicted orientation of physical barrier 310. Similar to physical barrier 118 of droplet actuator 100 of FIGS. 1A and 1B, a gap (not shown) that is smaller than the bead diameter is provided between physical barrier 310 and the droplet operations surface atop electrodes 110 for allowing fluid (not shown) only to be transported past the barrier using one or more droplet operations. Consequently, in one direction of flow, physical barrier 310 acts as a dam against which beads 126 may be lodged, thereby blocking the further downstream movement of beads 126.

In some embodiments, a series of such barriers may be employed to separate beads of different sizes. For example, a series of barriers with progressively smaller gaps between the barrier and the droplet operations surface can be used to retain progressively smaller beads. In this case, the barriers may effectively function as serial sieves. The largest beads get trapped at the first barrier while the other sizes can be transported through the barrier to the next barrier. The set of smaller sized beads are trapped at the second barrier while other still smaller beads are transported to a third barrier. The process can be repeated with additional barriers in series until substantially all of beads are depleted from the droplet.

In a similar embodiment, a series of barriers like the barriers illustrated in FIG. 1 may be employed. The barriers may have different gap heights at the entry and exit points to enable entry of larger beads at the entry point and retaining them at the exit point.

In another related embodiment, the barrier may be composed of pillar-like structures. The shape of these pillars can be cylindrical, hemispherical, or any other suitable shape. They may span the entire gap height between the top and bottom substrates or some subsection of the gap height. The dimension and materials used to construct the materials are selected to ensure that droplet operations can be performed through the pillars while retaining at the pillars any beads that are larger than the gaps between the pillars and/or gaps between the pillars at the surface of one of the substrates. A sieve can be formed with groups of pillars that have different spaces between them to allow beads of certain sizes to pass through. Gap sizes between the pillars can be set changing pillar diameter and/or pillar spacing. For example, gap sizes between the pillars can be set by fixing the pillar diameter and varying the spacing between pillars or by fixing the number of pillars and varying the diameter of each pillar. For example, such a design can be used for separating cells of different sizes from a sample matrix such as blood which has cells of different diameters. Similarly, differently sized beads can be separated using a series of sequentially smaller pillars as sieves.

In any bead separation operation using a physical barrier, it may be useful to shuttle the droplet back and forth across the barrier in order to permit smaller beads to traverse the barrier without being blocked by larger beads. Further, a traverse-and-split method may be used, whereby a droplet is transported past a barrier, and a new droplet is introduced to the retained beads. The new droplet may be shuttled back and forth one or more times to mix the beads in the droplet, after which the new droplet may be transported across the barrier. This process may be repeated until substantially all of the beads retained by the barrier are beads which have a diameter larger than the opening(s) in the barrier, and substantially all of the beads which have a diameter smaller than the opening(s) in the barrier have been transported across the barrier.

Figure 4:
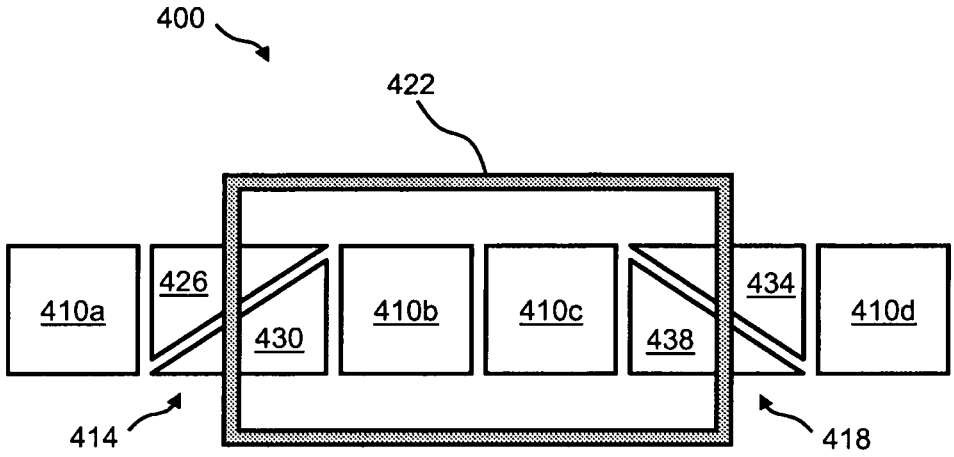

FIG. 4 illustrates a top view (not to scale) a droplet actuator 400 that includes a physical barrier that is suitable for manipulating beads in combination with an alternative electrode configuration. Droplet actuator 400 includes an arrangement of electrodes 410, e.g., electrowetting electrodes, in combination with a first electrode pair 414 and a second electrode pair 418 for performing droplet operations. Droplet actuator 400 further includes a physical barrier 414, which is, for example, substantially the same as physical barrier 118 of droplet actuator 100 or physical barrier 210 of droplet actuator 200. Physical barrier 414 is disposed in the gap of droplet actuator 400.

First electrode pair 414 includes a tapered (e.g., triangle-shaped) electrode 426 along with a corresponding opposite tapered electrode 430, as shown in FIG. 4, which spans one fluid entry/exit boundary of physical barrier 414. Similarly, second electrode pair 418 includes a tapered electrode 434 along with a corresponding opposite tapered electrode 438, as shown in FIG. 4, which spans the opposite fluid entry/exit boundary of physical barrier 414. Additionally, FIG. 4 shows that one or more electrodes 410 are arranged within physical barrier 414 and between first electrode pair 414 and second electrode pair 418 for facilitating droplet operations within the confines of physical barrier 414. Furthermore, a quantity of beads (not shown) is retained within physical barrier 414.

The geometry of electrode pair 414 and electrode pair 434 provide improved facilitation of the droplet operations by better facilitating the transport of droplets (not shown) across the boundaries of physical barrier 414. More specifically, favoring the movement of droplets into physical barrier 414, the smaller areas of, for example, tapered electrode 430 and tapered electrode 438 are located outside of physical barrier 414, which is favorable for causing the bulk of a droplet to align with the larger area of the triangle that lies inside of physical barrier 414. By contrast, favoring the movement of droplets out of physical barrier 414, the smaller areas of, for example, tapered electrode 426 and tapered electrode 434 are located inside of physical barrier 414, which is favorable for causing the bulk of a droplet to align with the larger area of the triangle that lies outside of physical barrier 414.

An example sequence for transporting a droplet from electrode 410*a* to electrode 410*b* is as follows. A droplet is transported to electrode 410*a*. Then electrode 430 is activated and electrode 410*a* is deactivated in order to pull the droplet onto electrode 430. Then electrode 430 is deactivated and electrode 410*b* is activated, which pulls the droplet onto electrode 410*b* that is inside physical barrier 414. In opposite fashion, electrode 426 is used for transporting the droplet in the opposite direction from electrode 410*b* to electrode 410*a*.

Figure 5:
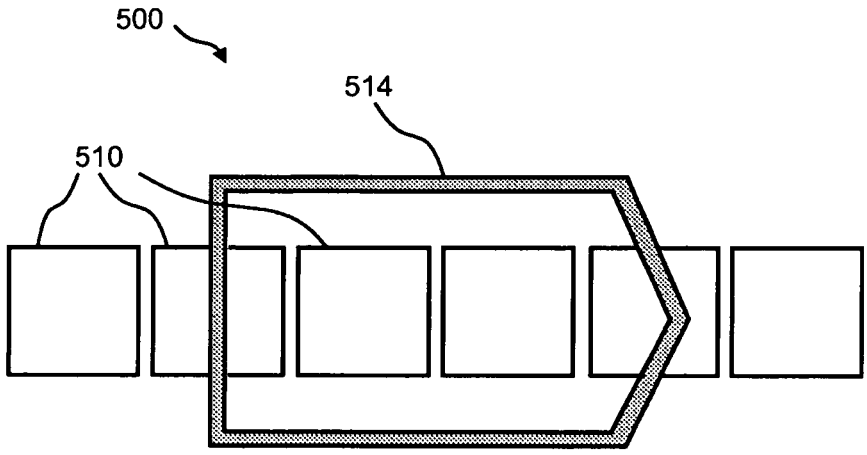

FIG. 5 illustrates a top view (not to scale) of a droplet actuator 500 that includes a physical barrier that has an alternative geometry that is suitable for manipulating beads. Droplet actuator 500 includes an arrangement of electrodes 510, e.g., electrowetting electrodes, for performing droplet operations. Droplet actuator 500 further includes a physical barrier 514, which is, for example, substantially the same as physical barrier 118 of droplet actuator 100 or physical barrier 210 of droplet actuator 200, except that it has an alternative shape. Physical barrier 514 is disposed in the gap of droplet actuator 500.

In the example of FIG. 5, one fluid entry/exit end of physical barrier 514 may have a pointed-shape, that is pointing away from the center of physical barrier 514, which is a geometry that is favorable for moving a droplet (not shown) into physical barrier 514. This is because the smaller area of a certain electrode 510 is located outside of physical barrier 514, which is favorable for a droplet to fill the larger area that is located inside of physical barrier 514. Alternatively, both fluid entry/exit ends of physical barrier 514 may have a pointed-shape that is pointing away from the center of physical barrier 514.

Figure 6:
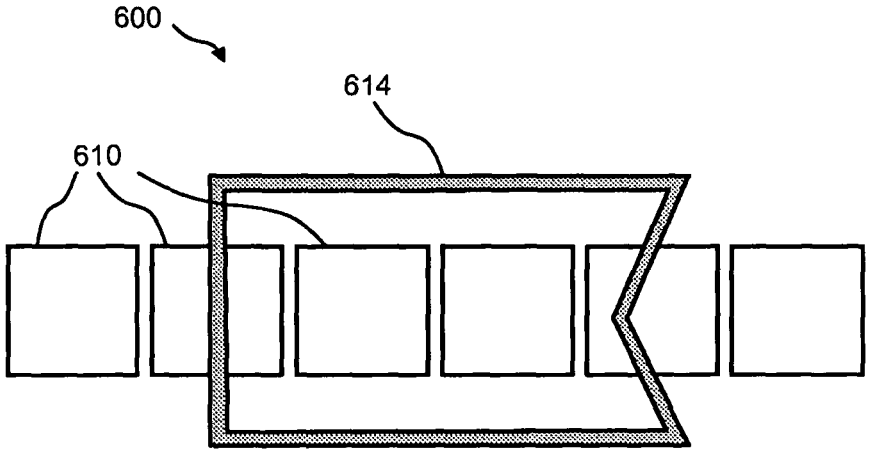

FIG. 6 illustrates a top view (not to scale) of a droplet actuator 600 that includes a physical barrier that has an alternative geometry that is suitable for manipulating beads. Droplet actuator 600 includes an arrangement of electrodes 610, e.g., electrowetting electrodes, for performing droplet operations. Droplet actuator 600 further includes a physical barrier 614, which is, for example, substantially the same as physical barrier 118 of droplet actuator 100 or physical barrier 210 of droplet actuator 200, except that it has an alternative shape. Physical barrier 614 is disposed in the gap of droplet actuator 600.

In the example of FIG. 6, one fluid entry/exit end of physical barrier 614 may have a pointed-shape that is pointing toward the center of physical barrier 614, which is a geometry that is favorable for moving a droplet (not shown) out of physical barrier 614. This is because the smaller area of a certain electrode 610 is located inside of physical barrier 614, which is favorable for a droplet to fill their larger area that is located outside of physical barrier 614. Alternatively, both fluid entry/exit ends of physical barrier 614 may have a pointed-shape that is pointing toward the center of physical barrier 614.

Referring again to FIGS. 5 and 6, a physical barrier may have a geometry that is the combination of droplet actuator 500 and droplet actuator 600. More specifically, one fluid entry/exit end of the physical barrier may have a pointed-shape that is pointing toward the center of the physical barrier, while the opposite entry/exit end of the physical barrier may have a pointed-shape that is pointing away from the center of the physical barrier.

Referring again to FIGS. 1A, 1B, 2A, 2B, 4, 5, and 6, during manufacturing, the beads may be placed within the respective physical barriers. Alternatively, the beads are fabricated within the physical barrier during the fabrication of the droplet actuator chip. As a result, a physical barrier that can completely retain the beads allows the beads to be transported and stored with the droplet actuator.

Figure 7:
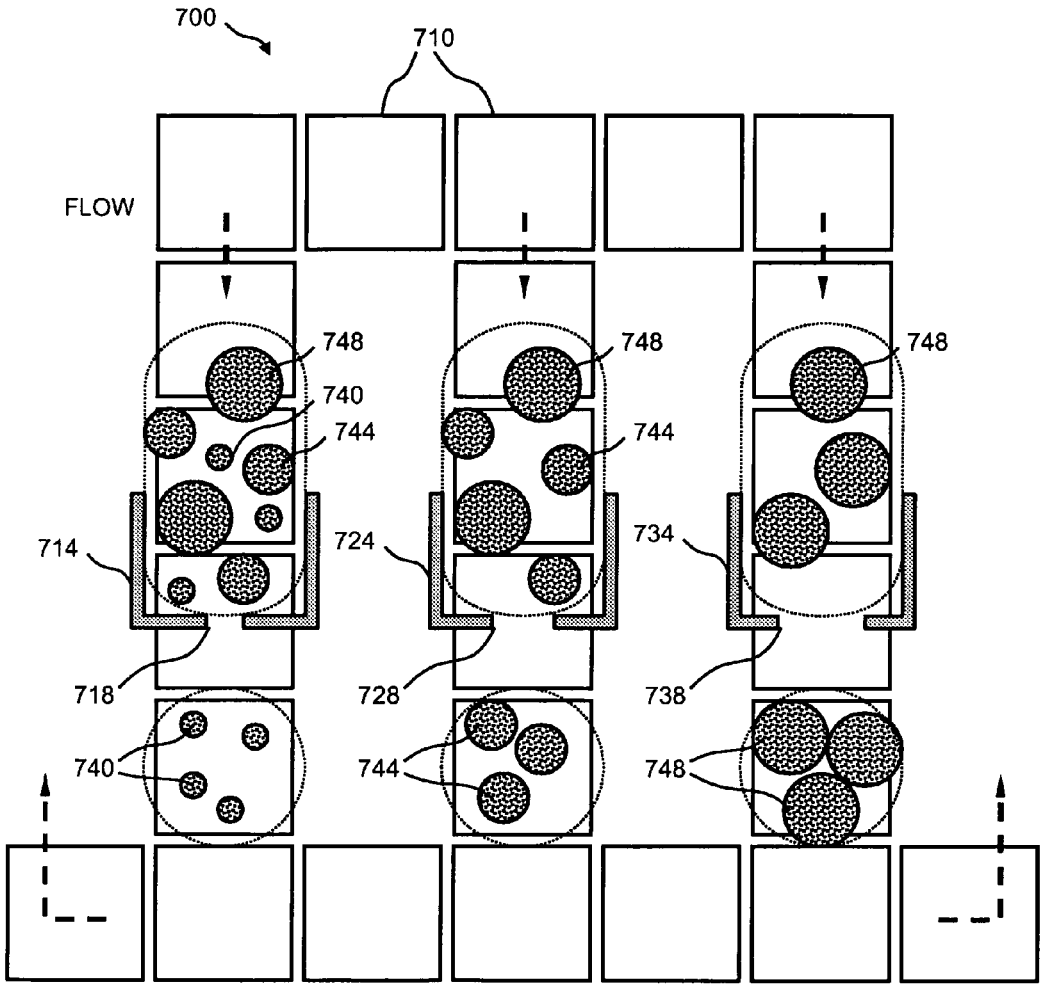

Referring again to FIGS. 1A through 6, a single droplet actuator may include multiple physical barriers of any type and combination of those described in FIGS. 1A through 6. In one application, a single droplet actuator may include different types of beads within different physical barriers, respectively. In one example, a droplet actuator may have an array of the box-shaped physical barriers of FIGS. 1A and 1B or 2A and 2B, where each barrier may contain a different type of bead. Because there may be a continuous arrangement of electrodes within the droplet actuator, increased flexibility is provided for moving one sample through all the different physical barriers and, thereby, providing the ability to perform different assays within the one droplet actuator. FIG. 7 illustrates more details of an example droplet actuator that includes multiple physical barriers. In one embodiment, the invention provides a droplet actuator with an array of the same or different kinds of trapped beads.

FIG. 7 illustrates a top view (not to scale) of a droplet actuator 700 that includes multiple physical barriers. In this example the multiple physical barriers are used to sort beads of differing size. For example, droplet actuator 700 includes a continuous arrangement (e.g., an array or grid) of electrodes 710, e.g., electrowetting electrodes, for performing droplet operations along multiple flow paths, such as, but not limited to, the arrangement shown in FIG. 7. Along a first arrangement of electrodes 710 is disposed a U-shaped physical barrier 714 that has an opening 716 of a certain size. Along a second arrangement of electrodes 710 is disposed a U-shaped physical barrier 724 that has an opening 726 of a certain size that is larger than opening 716 of U-shaped physical barrier 714. Along a third arrangement of electrodes 710 is disposed a U-shaped physical barrier 734 that has an opening 736 of a certain size that is larger than opening 726 of U-shaped physical barrier 724. Consequently, U-shaped physical barriers 714, 724, and 734 differ by the width of their respective openings.

The function of openings 716, 726, and 736 is to allow only the beads that are smaller than the openings to pass therethrough and to retain only the beads that are larger than the openings. Used in combination, as shown in FIG. 7, U-shaped physical barriers 714, 724, and 734 may be used to separate different sized beads. For example and referring again to FIG. 7, a method of using physical barriers for separating beads of different diameters includes, but is not limited to, one or more of the following steps. (1) providing a droplet actuator (e.g., droplet actuator 700 of FIG. 7) that includes an arrangement of continuous electrodes (e.g., electrodes 710 of FIG. 7) and an arrangement of multiple physical barriers (e.g., physical barriers 714, 724, and 734 of FIG. 7) with different sized openings; (2) moving a droplet that contains two or more sized beads into a first physical barrier (e.g., physical barrier 714 of FIG. 7) that has the smallest opening and then agitating the droplet, which causes the smallest beads to pass through the opening and causes larger beads to be retained; (3) moving a droplet that contains two or more sized beads into a next physical barrier (e.g., physical barrier 724 of FIG. 7) that has a slightly larger opening than the first physical barrier and then agitating the droplet, which causes the next larger beads to pass through the opening and causes yet larger beads to be retained; (4) moving a droplet that contains two or more sized beads into a next physical barrier (e.g., physical barrier 734 of FIG. 7) that has a yet larger opening then the previous physical barrier and then agitating the droplet, which causes the yet larger beads to pass through the opening and causes yet larger beads to be retained; and (5) repeating the above steps for any number of physical barriers and any number of corresponding sized beads.

In reference to FIGS. 1A through 7, in some embodiments, a physical barrier (with or without openings) may be arranged over a grid or array of electrodes, and droplets may enter and leave the physical barrier in multiple directions. In one embodiment, a square barrier (with or without openings) is provided along with a grid of square electrodes. In another embodiment, a hexagonal barrier (with or without openings) is provided along with a grid of hexagonal electrodes. In yet another embodiment, an octagonal barrier (with or without openings) is provided along with a grid of octagonal electrodes. The electrode shape and the barrier shape need not be the same and any combinations can be used.

It should be noted that in addition to barriers which extend from one or more of the substrates of the droplet actuator, the barriers may be formed by one or more depressions in a substrate.

7.2 Bead Manipulations when Loading a Droplet Actuator

Figure 8:
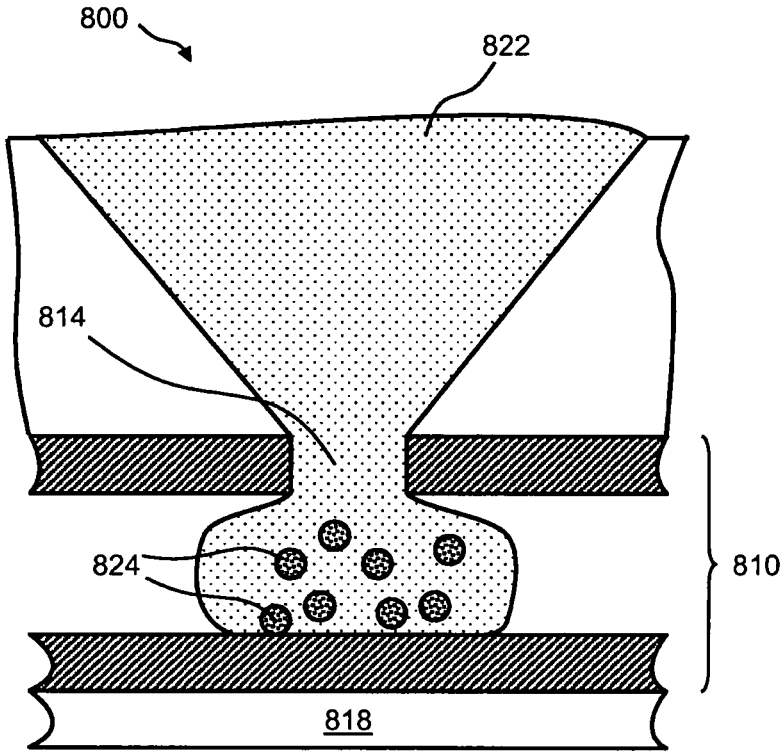

FIG. 8 illustrates a side view (not to scale) of a droplet actuator 800 that is being loaded in a manner so as to pinch off a droplet containing a sample that includes one or more targets (e.g., cells or molecules). FIG. 8 shows droplet actuator 800 having an input reservoir 810 that is fed via an inlet 814. Additionally, input reservoir 810 of droplet actuator 800 is arranged within the range of a magnetic field that is provided by a magnet 818.

FIG. 8 further shows a large volume sample 822 that contains a certain concentration of targets of interest. In one example, a quantity of magnetic beads 824 may be added to the large volume sample, which may be used to capture the target of interest upon. The sample having beads 824 with the targets of interest bound thereto may be moved into reservoir 810 of droplet actuator 800 via inlet 814. Because beads 824 are magnetic, beads 824 may be drawn into the bottom of the reservoir 810 that leads into the fluid channel (not shown) of droplet actuator 800 due to the magnetic field of magnet 818. Additionally, the magnetic field of magnet 818 causes beads 824 to be concentrated onto surfaces within droplet actuator 800. In this way, beads 824 are drawn into droplet actuator 800 and pinched off into a droplet, thereby concentrating the target of interest that is captured on beads 824 in the small volume droplet.

7.3 Droplet Actuator

For examples of droplet actuator architectures that are suitable for use with the present invention, see U.S. Pat. No. 6,911,132, entitled, "Apparatus for Manipulating Droplets by Electrowetting-Based Techniques," issued on Jun. 28, 2005 to Pamula et al.; U.S. patent application Ser. No. 11/343,284, entitled, "Apparatuses and Methods for Manipulating Droplets on a Printed Circuit Board," filed on filed on Jan. 30, 2006; U.S. Pat. Nos. 6,773,566, entitled, "Electrostatic Actuators for Microfluidics and Methods for Using Same," issued on Aug. 10, 2004 and 6,565,727, entitled, "Actuators for Microfluidics Without Moving Parts," issued on Jan. 24, 2000, both to Shenderov et al.; Pollack et al., International Patent Application No. PCT/US 06/47486, entitled, "Droplet-Based Biochemistry," filed on Dec. 11, 2006, the disclosures of which are incorporated herein by reference. Examples of droplet actuator techniques for immobilizing magnetic beads and/or non-magnetic beads are described in the foregoing international patent applications and in Sista, et al., U.S. Patent Application Nos. 60/900,653, filed on Feb. 9, 2007, entitled "Immobilization of magnetically-responsive beads during droplet operations"; Sista et al., U.S. Patent Application No. 60/969,736, filed on Sep. 4, 2007, entitled "Droplet Actuator Assay Improvements"; and Allen et al., U.S. Patent Application No. 60/957,717, filed on Aug. 24, 2007, entitled "Bead washing using physical barriers," the entire disclosures of which is incorporated herein by reference.

7.4 Fluids

For examples of fluids that may be subjected to droplet operations using the approach of the invention, see the patents listed in section 03, especially International Patent Application No. PCT/US 06/47486, entitled, "Droplet-Based Biochemistry," filed on Dec. 11, 2006. In some embodiments, the fluid that is loaded includes a biological sample, such as whole blood, lymphatic fluid, serum, plasma, sweat, tear, saliva, sputum, cerebrospinal fluid, amniotic fluid, seminal fluid, vaginal excretion, serous fluid, synovial fluid, pericardial fluid, peritoneal fluid, pleural fluid, transudates, exudates, cystic fluid, bile, urine, gastric fluid, intestinal fluid, fecal samples, fluidized tissues, fluidized organisms, biological swabs and biological washes. In some embodiment, the fluid that is loaded includes a reagent, such as water, deionized water, saline solutions, acidic solutions, basic solutions, detergent solutions and/or buffers. In some embodiments, the fluid that includes a reagent, such as a reagent for a biochemical protocol, such as a nucleic acid amplification protocol, an affinity-based assay protocol, a sequencing protocol, and/or a protocol for analyses of biological fluids. The fluid may be a fluid comprising a nutrient for a biological cell. For example, the fluid may be a culture medium or a component of a culture medium. The invention includes conducting one or more droplet operations to bring a culture medium or a fluid comprising a nutrient for a biological cell into contact with a biological cell population, e.g., a population that is adhered to one or more beads.

7.5 Filler Fluids

The gap is typically filled with a filler fluid. The filler fluid may, for example, be a low-viscosity oil, such as silicone oil. Other examples of filler fluids are provided in International Patent Application No. PCT/US 06/47486, entitled, "Droplet-Based Biochemistry," filed on Dec. 11, 2006.

This specification is divided into sections for the convenience of the reader only. Headings should not be construed as limiting of the scope of the invention. The definitions are part of the description of the invention. It will be understood that various details of the present invention may be changed without departing from the scope of the present invention. Various aspects of each embodiment described here may be interchanged with various aspects of other embodiments. Specific examples, dimensions and volumes described herein are for illustrative purposes only, and are not intended to limit the scope of the claimed invention.

We claim:

1. A droplet actuator comprising:

(a) a base substrate comprising electrodes configured for conducting droplet transport operations on a droplet operations surface thereof and a top substrate arranged parallel to the droplet operations surface to form a droplet operations gap, wherein the droplet operations gap comprises an oil filler fluid;

(b) a funnel-shaped reservoir in the top substrate comprising a narrow opening situated in proximity to the base substrate the reservoir comprising a liquid sample comprising beads;

(c) a magnetic field source situated sufficiently near the funnel-shaped reservoir to attract magnetic beads from the funnel-shaped reservoir onto the droplet operations surface;

wherein the base substrate and the funnel-shaped reservoir are arranged such that a portion of the sample comprising the beads loaded in the funnel is in contact with the droplet operations surface, and wherein the portion of the sample in contact with the droplet operations surface comprises a substantial amount of the beads.

* * * * *